United States Patent [19]

Felber

[11] Patent Number: 4,832,067

[45] Date of Patent: May 23, 1989

[54] WEATHER PROTECTIVE ROOFING FOR LIGHT AIRCRAFT

[76] Inventor: Josef Felber, Resedastrasse 20, CH-8008 Zurich, Switzerland

[21] Appl. No.: 85,876

[22] Filed: Aug. 13, 1987

[30] Foreign Application Priority Data

Aug. 25, 1986 [CH] Switzerland ..... 03404/86

[51] Int. Cl.[4] ..... E04B 1/34; A45F 1/14

[52] U.S. Cl. ..... 135/102; 135/113

[58] Field of Search ..... 135/102, 103, 104, 113; 52/67, 66

[56] References Cited

U.S. PATENT DOCUMENTS

| | | | |
|---|---|---|---|
| 823,372 | 6/1906 | Stevens et al. | 49/386 |
| 2,266,853 | 12/1941 | Dabney | 135/104 |
| 3,190,300 | 6/1965 | Wearn | 135/104 |
| 3,202,159 | 8/1965 | Reed | 135/113 |
| 3,540,458 | 11/1970 | Osterhoudt | 135/113 |
| 3,712,316 | 1/1973 | Leonard | 135/113 |

FOREIGN PATENT DOCUMENTS

| | | | |
|---|---|---|---|
| 594358 | 3/1960 | Canada | 135/104 |
| 1027727 | 3/1978 | Canada | 52/64 |
| 964081 | 10/1982 | U.S.S.R. | 52/66 |
| 1027911 | 4/1966 | United Kingdom | 52/66 |

*Primary Examiner*—Henry E. Raduazo

*Attorney, Agent, or Firm*—Thomas W. Speckman

[57] ABSTRACT

A weather protective roofing structure for small aircraft comprising a plurality of hemispherical bars which are supported in a rotatable manner around a common axis, which bars are attached to and covered with a plurality of covering material segments forming a hemispherical cover. The hemispherical bars are rotatable around the common axis by means of a tackle apparatus and an electrical winch during assembly of the roofing structure to form an enclosure, and during disassembly and folding of the hemispherical cover. Assembly and disassembly are facilitated by means of two torsion springs provided at the hinge assemblies and attached to the outermost bar.

32 Claims, 7 Drawing Sheets

WEATHER PROTECTIVE ROOFING FOR LIGHT AIRCRAFT

BACKGROUND OF THE INVENTION

One and two-engine light aircraft are generally used infrequently over the course of the year. During the winter months and during other periods of bad weather, they often sit idle for long periods on the ground. Since aircraft are generally costly investments and sensitive machines, it is desirable to store them in hangars during periods of inactivity to protect them from the influence of atmospheric conditions. An aircraft covered with snow or coated with hoarfrost or even a layer of ice requires considerable preparation and expense to be made ready for take-off. When an aircraft is stored in a hangar, however, these time consuming flight preparation activities are eliminated.

A large number of light aircraft are, for the reasons just indicated, stored in hangars. That is to say, the aircraft are parked in a permanent building. If suitable safeguards are lacking, then it may be advisable to cover the cockpit with a special tarpaulin.

Because of the bulkiness of their shape, aircraft require a considerable amount of space, and hangar places are therefore correspondingly expensive. In order to use the space available in a hangar as intelligently as possible, light aircraft are arranged with one another on the ground in a "jigsaw puzzle" fashion. However, there are a number of disadvantages of this arrangement: for example, several planes must be reparked or even moved from the hangar into the open to provide access to a specific machine, which may then be rolled outside. If the flight crew will be traveling for a long time, the aircraft generally must be moved back to their respective places again. When the plane returns from its flight, the procedure begins all over again, until all the aircraft have again been removed from and replaced in the hangar. This removing and reparking work is tedious and time-consuming hard work. Four-seat planes can hardly be moved by a single person. There is also the danger, during such maneuvers, of contacting other aircraft and damaging them. These tedious moving and reparking operations contribute to the fact that use of the aircraft is avoided, because of the inordinate expenditure of energy to make the plane ready for take-off. If aircraft are not stored in a hangar, however, they are exposed to the weather, and they require, because of dust, snow, ice, etc., considerable preparatory work for flight. The problems described here are known to almost all mechanical aviation groups, in which circles reference is frequently made to the "hangar problem". In addition, at most airfields, too few hangar places are available. In most cases, apart from the difficulties in raising the necessary capital for constructing a permanent building, the change of receiving construction approval are very unlikely.

SUMMARY OF THE INVENTION

An object of the present invention is to provide a weather protective roofing for light aircraft which solves all the problems described above, and is furthermore much more reasonable in cost than a conventional hangar.

This objective is achieved by providing a weather protective roofing structure comprising a plurality of tubular metal bars having a semicircular configuration, each of the bars rotatable around a common rotational axis at a hinge joint. Equally sized segments of covering material are provided between each of the tubular bars and a tackle apparatus spans the bars and the covering material. A torsion spring is provided at the hinge joint with its axis coinciding with the rotational axis of the hinge joint, the torsion spring having at least one spring blade attached to the outermost bar so that it is rotatable over a range of 0° to 180°. The tackle apparatus aids in assembling the roofing by rotation of the tubular bars and covering material to form an enclosure and disassembling the roofing to form a flat semicircular structure. The aircraft is parked along the rotational axis of the bars. In accordance with the present invention, this construction provides the advantage that every aircraft has its own hangar, and may therefore be made rady for take-off very quickly. There is no longer any danger of contacting and damaging other planes during parking operations. A single person may open the weather protective roofing with ease by means of a tackle apparatus, which pulls the roofing over to one side of the aircraft and deposits it on the ground. This rotation and folding of the covering material is accomplished against the force of two torsion springs, so that when the weather protective roofing is erected to provide an enclosure the springs are tensed, and the weather protective roofing may then be disassembled by folding over onto itself and being deposited on the ground in a semicircular form. In the disassembled, folded condition, the bar which is now resting on top may be additionally secured to the lowermost bar or an independent structure on the ground with a wire cable or a chain. The aircraft then stands free and is ready to taxi for take-off. It does not need to be pushed either forward or backward. The aircraft pilot may roll the plane out from the parking space along a curved path, and is thus ready to taxi directly from the parking space. Conversely, the pilot may simply taxi the aircraft, upon his return, from the rear side, along a curved path back into the disassembled semicircular weather protective roofing which is folded up on the ground, and the roofing may then be unfolded and assembled by utilizing the force of the torsion springs to rotate the bars, thereby providing a weather protective enclosure over the aircraft.

BRIEF DESCRIPTION OF THE DRAWINGS

An advantageous exemplary embodiment of the weather protective roofing in accordance with the present invention is shown in the drawings, in which.

DESCRIPTION OF PREFERRED EMBODIMENTS

Figure 1:
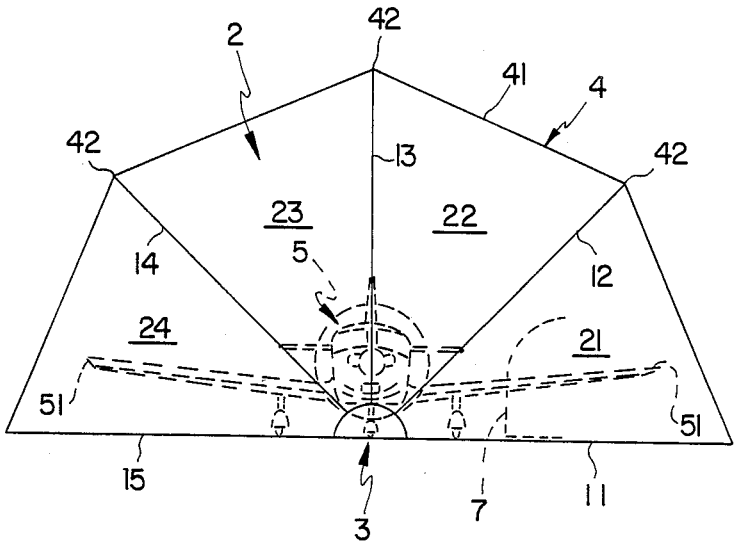
FIG. 1 shows a front view of the weather protective roofing structure.
Figure 4A:
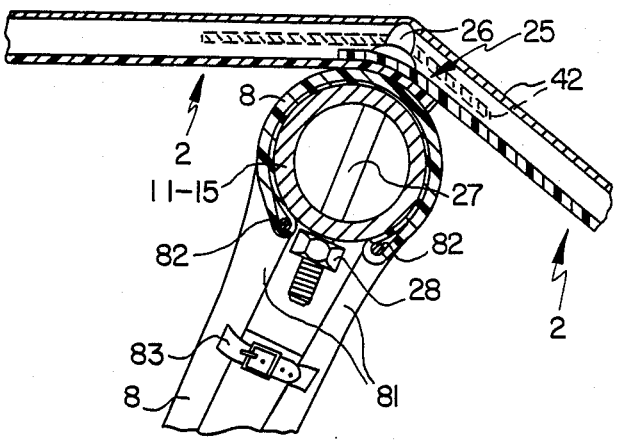
FIG. 4A shows an enlarged perspective view, partially in cross section, of a tubular bar with two adjacent sections of covering material.
Figure 10:
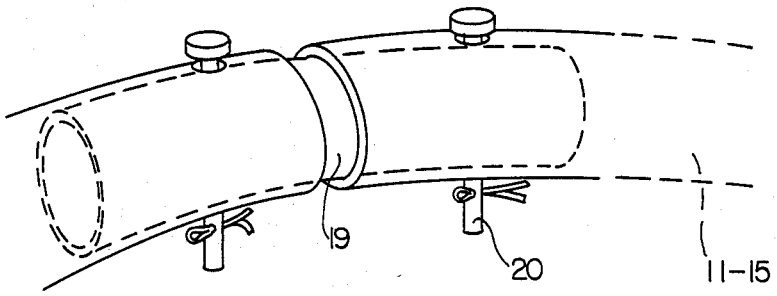
FIG. 10 shows a perspective view of two bulbular sections, connected by means of an insertion tube.

FIG. 1 shows an overall view of a weather protective roofing structure in accordance with the present invention, having five semicircular bars (11–15) aligned along a common rotational axis. Covering material (2) is divided into four cover segments (21–24) by bars (11–15). Each of these cover segments (21–24) is cut out as a flat piece of material, and individual cover segments (21–24) are joined in an overlapping manner along their longitudinal sides. By this means, connection of cover segments (21–24) to form a hemispherical enclosure is attained. This overlapping (25) as best seen in FIG. 4A additionally provides reinforcement at the point where the covering material (2) overlies the bars (11–15). In one preferred embodiment, covering material (2) comprises a textile cloth-reinforced plastic foil, and each cover segment is fastened to the adjacent cover segment at their longitudinal sides to form a water-tight, reinforced, and overlapping joint, Individual bars (11–15) may comprise a plurality of tubular sections which are connectible by means of insertion tubes (19), and, in the area of the joints, bolts (26) may be fastened through the insertion tubes (19) and the bars (11–15), as best seen in FIG. 10. Bars (11–15) are, at each end, articulated at hinges (3), so that they are rotatable by 180° around a common rotational axis. They may be rotated to assemble and disassemble an enclosure by means of tackle apparatus (4) extending over the bars (11–15) and their covering material at about the mid-point of the bars (11–15). At least one line (41) is thereby conducted over all of the bars (11–15) and individual segments (21–24) generally perpendicular to the longitudinal axis of bars (11–15) at the apex (42) formed by bars the mid-points of (11–15) in the asembled position of the weather protective roofing. The length and tension of the line is adjustable by means of pulling forces, since it corresponds to the large semicircle. First bar (11) that is the outermost at one side always remains lying on the ground. One end of line (41) is attached to the opposite outermost bar (15) which is opposite first bar (11). The roofing assembly may be rotated around the hinge axis by means of an electrical winch, not shown here, whereby initially, all movable bars (12–15) are rotated simultaneously, and cover segment (21) is therefore folded first. As soon as bar (12) rests on bar (11), the folding of cover segment (22) begins, and so on, until all bars (11–15) rest upon one another, and the covering material (2) lies folded on the ground. For the sake of a clearer understanding, aircraft (5) is shown in dashed lines, and it is also shown how it it positioned in the weather protective roofing structure in accordance with the present invention. It is important that aircraft (5) is, as shown, positioned with its longitudinal axis along the rotational axes of hinges (3). An objective of the present invention is now fully realized, namely, that aircraft (5), when the weather protective roofing is disassembled or folded, may be rolled both into and out from the roofing assembly.

Figure 2:
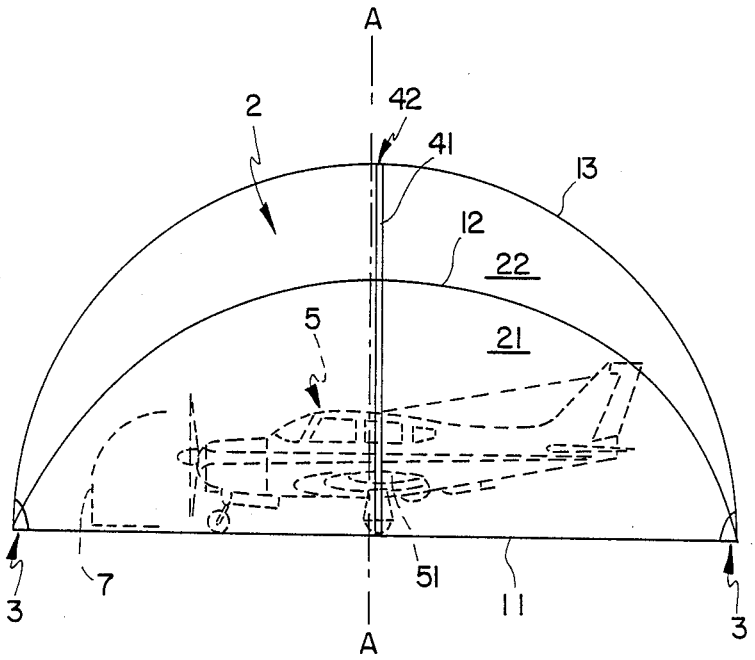
FIG. 2 shows a side view of the weather protective roofing structure.

FIG. 2 shows a side view of the weather protective roofing. The semicircular curvature of the bars (11–15) and the cover segments (21–24) which are stretched over the bars (11–15) is clearly evident. Furthermore, aircraft (5), which has been moved inside, is shown. It is preferably positioned with the axis between its wing tips (51) underneath the apex (42) of the roofing assembly, where the maximum space in the lateral direction is available to accommodate the wingspan of wings (51). Most aircraft have a greater wingspan than length. Free space therefore remains along the rotational axis in front of the parked aircraft (5), which makes it possible to remove the plane from the opened weather protective roofing structure by engine power without any danger to the roofing assembly.

Figure 3:
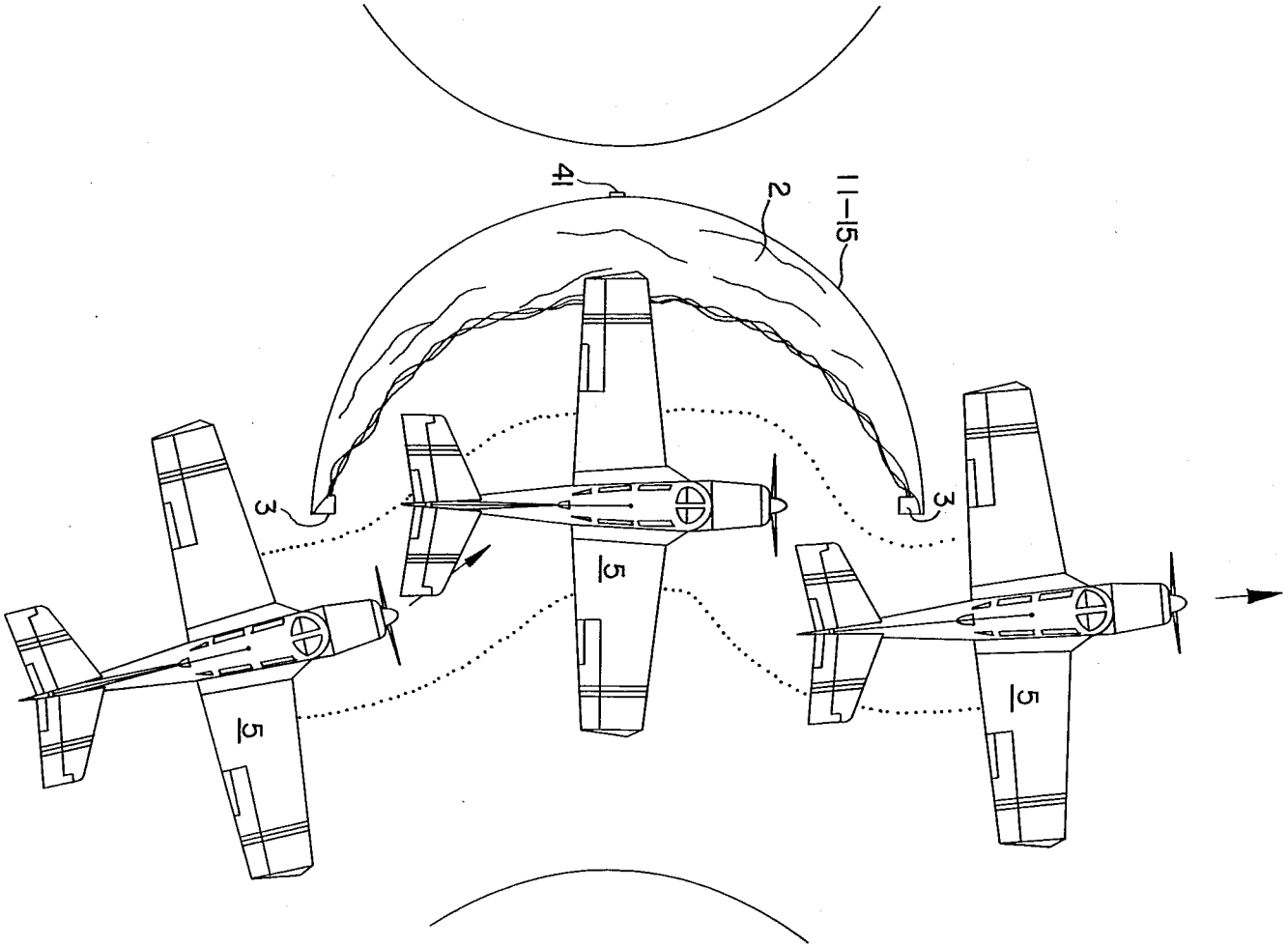
FIG. 3 shows a top view of the disassembled, folded weather protective roofing structure and illustrates the path of an aircraft entering and exiting the hangar.

FIG. 3 shows the weather protective roofing in a disassembled condition folded up on the ground, and shows the path of the plane entering and exiting the roofing assembly. The bars (11–15) rest on top of one another, while the covering material (2) is folded up on the ground. The path of aircraft (5) is shown by the dotted lines and arrows. The space between hinge assemblies (3) is completely free, and therefore provides problem-free maneuvering.

Figure 4:
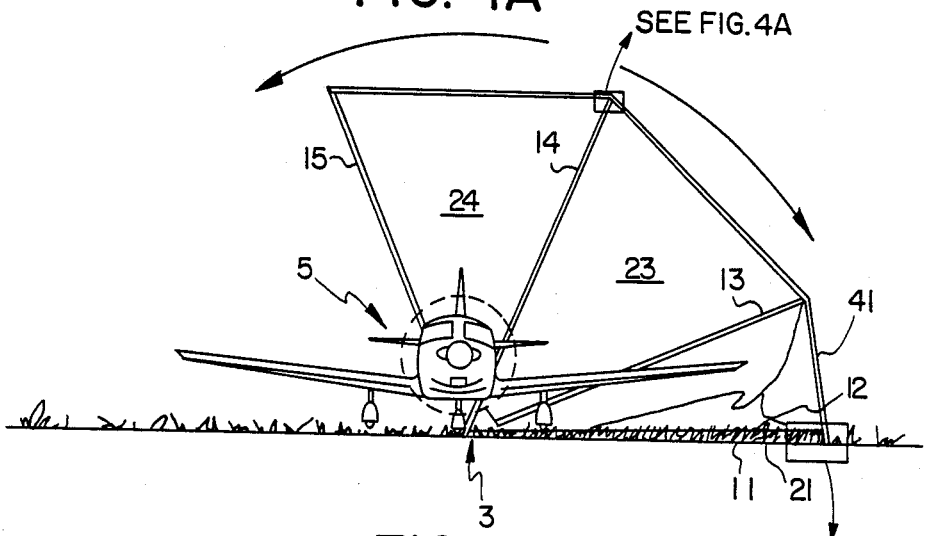
FIG. 4 shows a front view of the weather protective roofing, approximately half folded up, taken along line A—A as shown in FIG. 2.
Figure 4B:
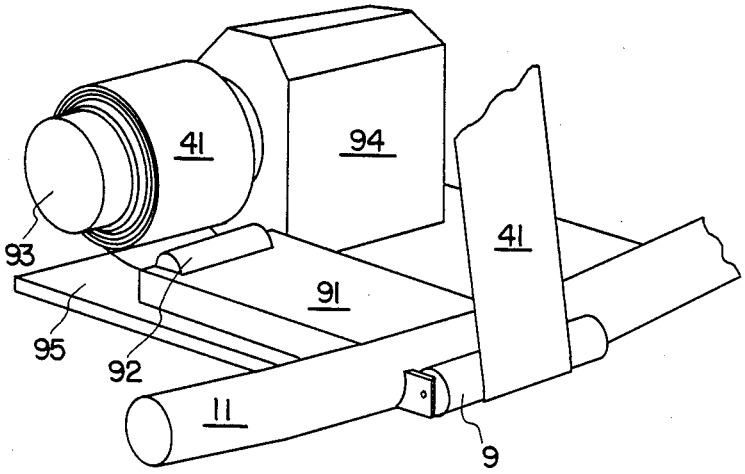
FIG. 4B shows an enlarged perspective view of the winch at the lowermost bar.
Figure 9:
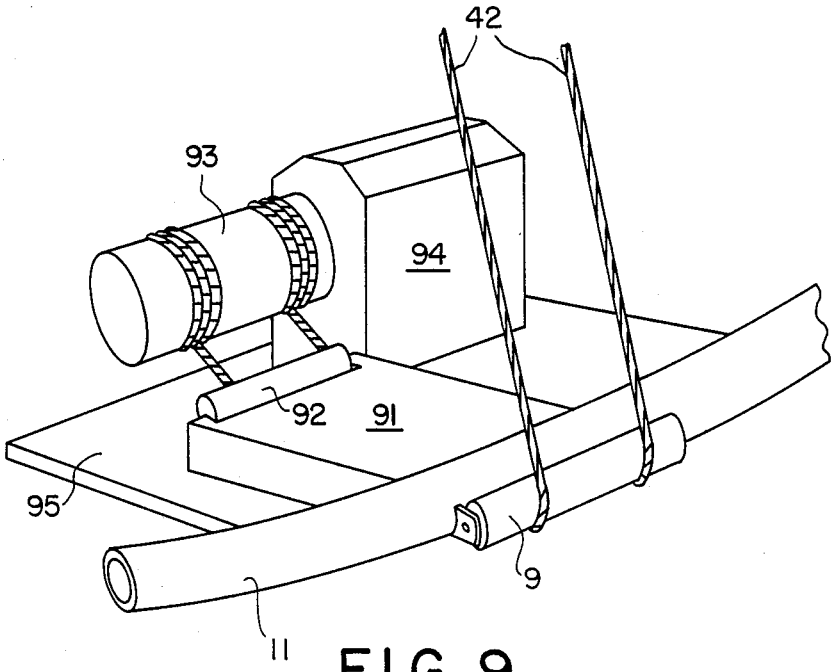
FIG. 9 shows a perspective view of the winch with two cables.

FIG. 4 shows, from the front and along line A—A as shown in FIG. 2, the process for assembling and disassembling the weather protective roofing structure. FIGS. 4A and 4B show enlarged views to explicate details of operation. Both bars (11) and (12) already rest on the ground on top of one another, and cover segment (21) positioned between them is folded up between the semicircular bars (11) and (12). Since the weight of the bars and covering material extending between them is greater on the right side of the rotational axis of the hinges after the outermost bar (15) has been moved, torque is exerted by the torsion springs on the outermost bar (15) in a counterclockwise direction, and cover segments (23) and (24) always remain stretched, until the corresponding bars (13) and (14), respectively, have been positioned on the ground. To ensure that the first folding takes place at cover segment (21) during the lifting of the outermost bar (15), an elastic cord or a draw string may be tightened between bars (11) and (12). Tackle assembly (4) may comprise a textile band of a type that is also used in support or tightening cords. Textile band (41) extends along the outer part of the covering segments and over the apex of the bars. For safety purposes, a double tackle assembly may also be provided. Such a double tackle assembly preferably comprises two wire cables (42) conducted in parallel over the apex of the roofing assembly. Where the wire cables (42) extend over (shown in solid lines in FIG. 4A) the bars, they are preferably conducted over or through (shown in dashed lines in FIG. 4A) flexible elements such as rubber elements (26) which are fastened to the cover segments at the bars. These rubber elements (26) are fastened by bolts (27) to the covering material (2). The bolts (27) pass through the bars (11–15) and are held by nuts (28). The cables (42) are conducted over rubber elements (26), making sure that they do not damage the cover material (2). They function, on the one hand, as spacing devices, so that the wire cables (42) do not chafe the covering material. On the other hand, because of their static friction with the wire cables (42), they help to retain the cables (42) so that the folding is initiated as desired. Winding up of the tackle assembly (4) advantageously take place by means of an electrical winch, which is positioned near the first bar (11) which always rests on the ground, whereby the cables and the textile band (41), respectively, are passed through under bar (11) as shown in FIGS. 4B and 9. The winch may be an electrical winch with either one long cable drum or two cable drums with one on each side of the winch. Where wire cables are used, they are preferably wound up on a cable drum with recessed winding grooves, so that orderly winding is ensured. The winch may be remotely controlled by means of a cable. In order to open the weather protective roofing, the operator may enter the interior of the enclosure through a special entry opening (7), which is created, for example, by means of a slide fastener such as a zipper, in one covering segment adjacent one of the outermost bars as shown in FIG. 2. Upon activation of the cable winch, bars (11–15) are rotated, and the covering material (2) is simultaneously folded on the ground near bar (11). Remote control of the winch by means of a cable allows the operator to observe and supervise the process of closing or opening the roofing assembly from any chosen position within the weather protective roofing and to stop the process, if necessary, at any given time. As soon as the weather protective roofing has been completely rotated and folded, bar (15) may be secured to bar (11) by means of a chain, a cable, or a special hook. The pilot now has free access to the aircraft. He may perform pre-flight checks, and is then ready for moving (taxiing) directly from the parked position. Moving of the aircraft manually may be eliminated, so that the maneuvering during which damage is most frequently caused to aircraft is eliminated. As shown in FIG. 3, the aircraft may now be moved along a slightly curved path from its parked position, to avoid touching the bars (11–15) which are lying on the ground. After releasing the bars from attachment to one another, the tackle assembly (4) may be released by the winch, whereupon one bar after another is rotated by the force of the torsion springs, which are aligned with the rotational axes of hinges (3). In the enclosed position of the weather protective roofing structure, the outermost bar (15) may additionally be secured in position by means of fasteners on the ground. The operator may again exit the weather protective roofing by way of opening (7). To ensure secure positioning of the enclosed roofing assembly, even under strong wind conditions, the bar (11) may also be secured to a soft surface by means of tent pegs, or to concrete and asphalt surfaces by means of dowel studs.

FIG. 4A shows how the covering material is advantageously attached to the tubular bars. Band (8) is glued or fused to the covering material along the overlap area between two cover segments (23, 24). The longitudinal edges of band (8) each form a flap (81). Round metal pieces (82) may be inserted into flaps (81), and straps (83) may be conducted through apertures provided in band (8), which straps may either be tightened around band (8) enclosing the bar (14), or may simply be tightened around both round steel units (82) provided in flaps (81).

FIG. 4B shows how band (41) is conducted around bar (11). It is drawn across a specially positioned roller (9), and through protective steel housing (91), at the end of which it is wound onto lateral winding drum (93) after contacting an additional roller (92). Winch (94) itself is firmly connected near bar (11) by means of a plate (95). The winch is preferably operated by a 12-volt power source. Such winches are customary for use with tow trucks.

Figure 5:
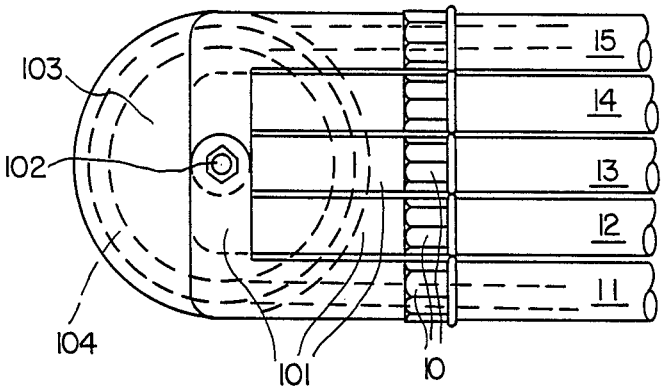
FIG. 5 shows a front view of a rotating hinge assembly.

FIG. 5 shows a front view of a rotating hinge joint. At the ends of bars (11–15), caps (10) are attached, such as by screwing, to which caps specially formed flat steel pieces (101) may be fastened, by means of which the bars are pivotable about their common rotational axis. Adjoining the hinge joint, a flange (103) may be positioned aligned with the rotational axis.

Figure 6:
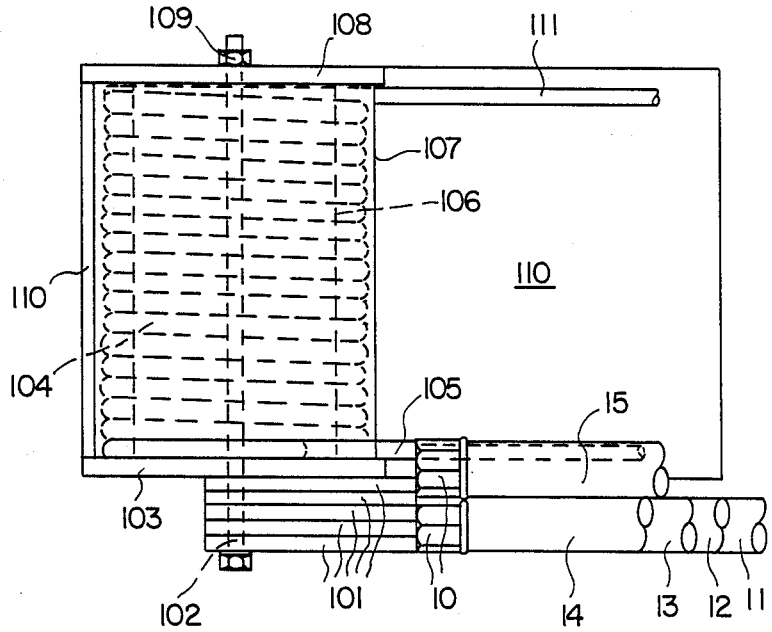
FIG. 6 shows a top view of a rotating hinge assembly with a torsion spring.
Figure 8:
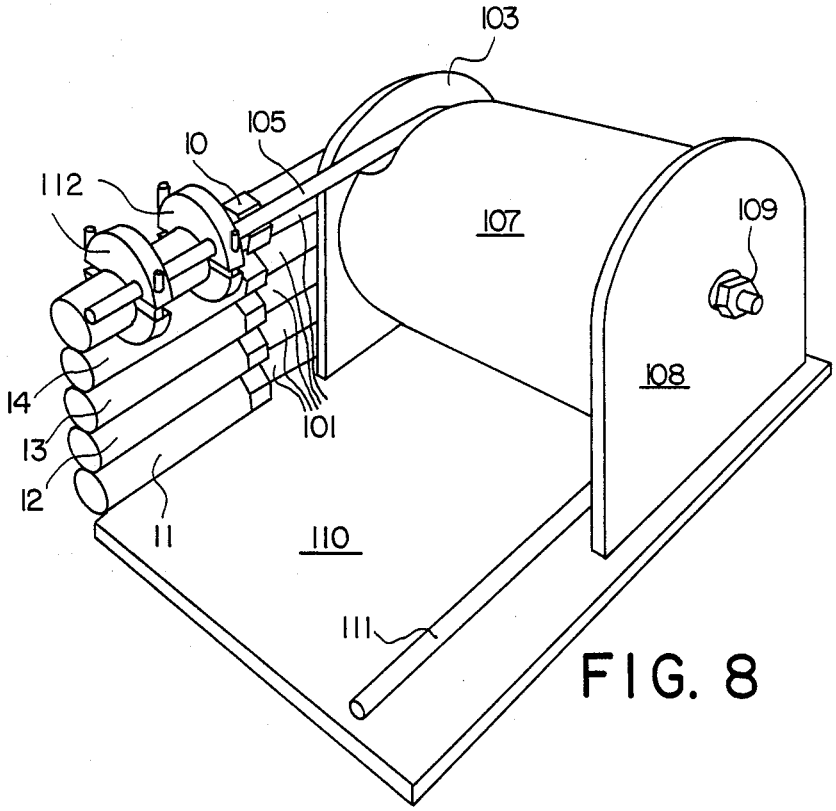
FIG. 8 shows a rear perspective view of a rotating hinge assembly whereby the spring blade is connected with the outer surface of the bar.

The same hinge joint is shown from above in FIG. 6, together with torsion spring (104). Torsion spring (104) is aligned with the common rotational axis, which is defined by a square cap square screw (102). Spring blade (105) of torsion spring (104) may be inserted into the interior of outermost bar (15). To make it easier to change the torsion springs, spring blade (105) may also be simply connected to the outer surface of bar (15) in a reinforced but detachable manner. Such a connection may be established by means of suitably strongly constructed units (112) as shown in FIG. 8. Tube (106) is preferably provided aligned with and inside the torsion spring, and is preferably clamped on screw (102) between flange (103) and second flange (108) by means of nut (109). Tube (106) provides the torsion spring with additional support, while a second larger tube (107), which is positioned concentrically and is likewise clamped between the flanges (103, 108) to protect the spring and enclose it. Both flanges (103, 108) are solidly connected to base plate (110), on which the second spring blade (111) is supported. Spring blade (111) may, however, also be supported in a reinforced manner in second flange (108). In this embodiment, flange (108) may be rotatable relative to the common rotational axis, for example by using a special wrench. In this way, the spring force may be adjusted as desired.

Figure 7:
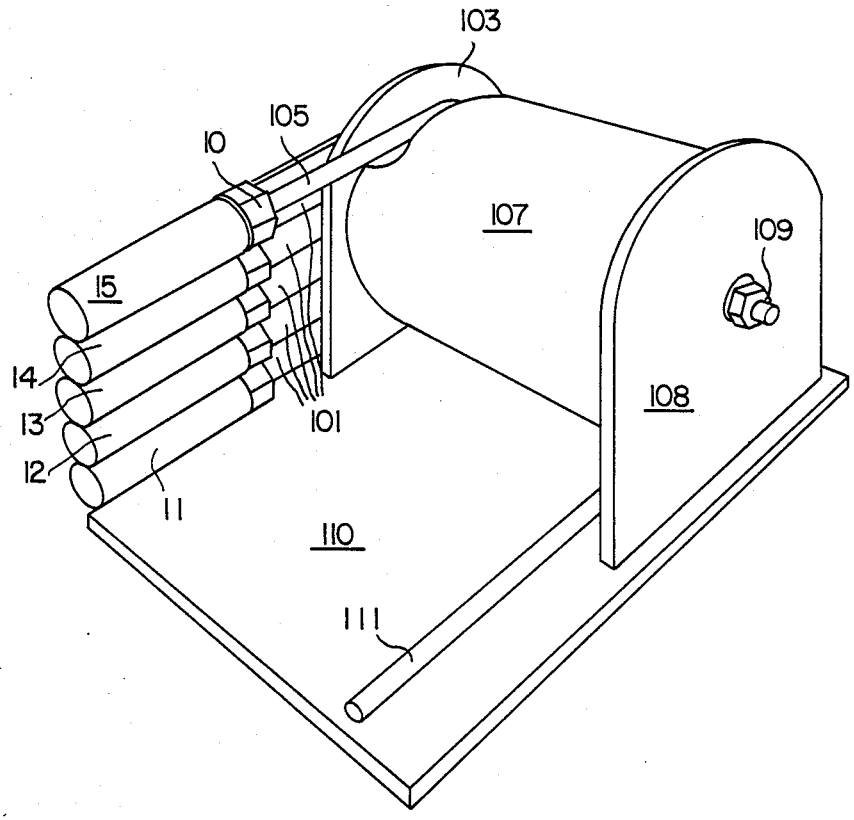
FIG. 7 shows a rear perspective view of a rotating hinge assembly with a torsion spring.

FIG. 7 shows the same arrangement in a perspective view from behind. Base plate (110) is connected to bar (11) in a reinforced manner. It is also possible that spring blade (111) may be bent rectangularly twice, and inserted into the interior of bar (11).

Figure 11:
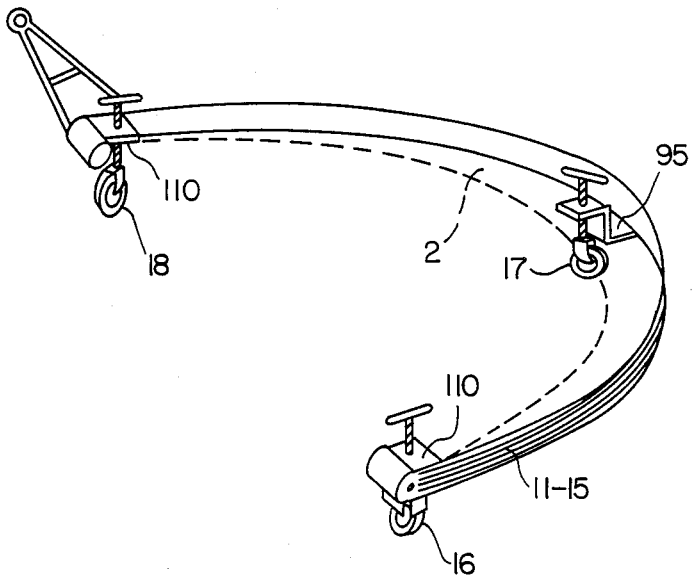
FIG. 11 shows a perspective view of the folded weather protective roofing with the height-adjustable moving chassis.

To increase the mobility of the weather protective roofing assembly in accordance with the present invention, bar (11), which always remains at the ground level, may be provided with a height-adjustable moving chassis. Such a moving chassis preferably comprises three wheels which are attached to the ends of bar (11) at base plates (110), and at the center of bar (11), to plate (95). A wheel (16) positioned on one end is not controllable, while the other two wheels (17, 18) may be freely steered as shown in FIG. 11. The weather protective roofing may therefore be portable when necessary, and may be converted quickly. It may be attached to a vehicle, and moved around the airstrip area as desired.

When the weather protective roofing is set up in a grassy area, it is preferable to cover the enclosed surface with paving tiles. By this means, the growth of grass is not prevented, and, in the event of excessive wetness, a solid base remains.

In addition to the advantages of the weather protective roofing in accordance with the present invention which have already been stated, it should be further stated that it requires no more room to set up than is generally required for aircraft parked in rows. This is shown in FIG. 3 by the portable hangars which are assembled in a row next to one another. A safety distance from wing tip to wing tip is maintained between aircraft parked in the open, which affords sufficient space for the hemispherical bars of the weather protective roofing assembly on the ground.

The construction time for the weather protective roofing of the present invention, as well as its assembly time is negligible in comparison with construction of conventional hangars. It can be assembled and ready for use within a matter of hours. Overall, the use of a weather protective roofing structure in accordance with the present invention is in all respects more practical, and also more cost-effective than a conventional hangar. Also, the problem of construction authorization is circumvented. Regulated constructions in the public and legal sense include buildings and building-like objects, as well as any objects which are artificially constructed and firmly attached to the ground. The weather protective roofing in accordance with the present invention is simply attached to the ground in a detachable manner, by means of tent pegs or by means of snap hooks, so that it in no way constitutes a building in the juridical sense. If it is equipped with a moving chassis, then it may legally fall into the category of vehicles. Applications for building and assembling the weather protective roofing in accordance with the present invention are therefore not necessary. If the cable winch is operated with a low-voltage power source, for example, a 12 volt battery, then providing appropriate current feed cables does not require the granting of any licenses, and automobile batteries may be used.

I claim:

1. A weather protective roofing structure for light aircraft, comprising a plurality of elongated bars in close side-by-side relation in an open position of said structure and in spaced side-by-side relation in a closed position of said structure, each said bar having the same semicircular configuration; two hinge assemblies, each end of each said bar articulated in a rotatable manner around a common rotational axis at said hinge assemblies; a plurality of covering material segments fastened to one another to form a hemispherical cover and attached to said bars; a tackle apparatus extending over said bars and said covering material segments at about an apex of said bars and in a direction generally perpendicular to a longitudinal axis of each said bar; a torsion spring provided at and aligned with each said hinge assembly so that its operating axis coincides with said common rotational axis of said hinge assemblies, each said torsion spring having at least one spring blade connected to an end of a first outermost bar of said plurality of bars, whereby said torsion spring maintains said first outermost said bar at an angle of about 180° from a second opposite outermost bar of said plurality of bars to provide a hemispherical enclosure in said closed position, and said bars are rotatable by means of said tackle apparatus to fold said roofing structure in said open position.

2. A weather protective roofing structure for light aircraft in accordance with claim 1, wherein said weather protective roofing structure additionally comprises a winch operatively connected with said tackle apparatus for adjusting said roofing structure to said closed position and said open position.

3. A weather protective roofing structure for light aircraft in accordance with claim 2, wherein said winch is electrical and a remotely controllable electrical power source is operatively connected to said winch.

4. A weather protective roofing structure for light aircraft in accordance with claim 3, wherein said bars have a hollow tubular structure and said at least one spring blade of each said torsion spring is inserted into an interior of one of said first outermost bar and said second opposite outermost bar.

5. A weather protective roofing structure for light aircraft in accordance with claim 4, additionally comprising a moving chassis which is adjustable in height provided on said second opposite outermost bar, said moving chassis comprising a first wheel positioned at one end of said bar, a second wheel positioned at an opposite end of said bar and a third wheel positioned at said apex of said bar, and wherein one of said first wheel and said second wheel is not controllable, while the other of said first wheel and said second wheel, and said third wheel are freely controllable.

6. A weather protective roofing structure for light aircraft in accordance with claim 5, wherein said covering material segments comprise textile cloth-reinforced plastic foil, and each said covering material segment is fastened to an adjacent said covering material segment at longitudinal sides of said covering material segments to form a water-tight, reinforced, and overlapping joint.

7. A weather protective roofing structure for light aircraft in accordance with claim 6, additionally comprising a band attached to an inner surface of said hemispherical cover at each said joint of said covering material segments, a width of said band corresponding generally to a circumference of said bars and each said band encircling a corresponding said bar, longitudinal edges of said band forming a plurality of flaps, at least one reinforcing rod inserted in each flap, and said band additionally provided with a plurality of slot apertures and at least one strap threaded through said slot apertures and tightened around said reinforcing rods to securely fasten said covering material segments to said bars.

8. A weather protective roofing structure for light aircraft in accordance with claim 7, wherein each said torsion spring is supported by a first cylindrical tubular section aligned with and inside said torsion spring and a second cylindrical tubular section aligned with and outside said torsion spring, said first cylindrical tubular section and said second cylindrical tubular section are clamped between a first flange and a second flange, each said first flange is adjacent each said hinge assembly, and said second flange attached to and spaced from said first flange with a screw which defines said common rotational axis of said hinge assembly and which extends along a central longitudinal axis of said torsion spring.

9. A weather protective roofing structure for light aircraft in accordance with claim 1, wherein each said bar comprises a plurality of curved tubular sections which are fastened to one another by insertion tubes, and lateral bolts are inserted through said insertion tubes and said tubular sections as fasteners.

10. A weather protective roofing structure for light aircraft in accordance with claim 9, wherein one of said covering material segments attached to said first outermost bar and said second opposite outermost bar is provided with an entry opening which is sealable by a slide fastener.

11. A weather protective roofing structure for light aircraft in accordance with claim 1, wherein said bars have a hollow tubular structure and said at least one spring blade of each said torsion spring is inserted into an interior of said first outermost bar and said second opposite outermost bar.

12. A weather protective roofing structure for light aircraft in accordance with claim 1, additionally comprising a moving chassis which is adjustable in height provided on said second opposite outermost bar, said moving chassis comprising a first wheel positioned at one end of said bar, a second wheel positioned at an opposite end of said bar and a third wheel positioned at said apex of said bar, and wherein one of said first wheel and said second wheel is not controllable, while the other of said first wheel and said second wheel, and said third wheel are freely controllable.

13. A weather protective roofing structure for light aircraft in accordance with claim 1, wherein said covering material segments comprise textile cloth-reinforced plastic foil, and each said covering material segment is fastened to an adjacent said covering material segment at longitudinal sides of said covering material segments to form a water-tight, reinforced, and overlapping joint.

14. A weather protective roofing structure for light aircraft in accordance with claim 1, additionally comprising a band attached to an inner surface of said hemispherical cover at each said joint of said covering material segments, a width of said band corresponding generally to a circumference of said bars and each said band encircling a corresponding said bar, longitudinal edges of said band forming a plurality of flaps, at least one reinforcing rod inserted in each flap, and said band additionally provided with a plurality of slot apertures and at least one strap threaded through said slot apertures and tightened around said reinforcing rods to securely fasten said covering material segments to said bars.

15. A weather protective roofing structure for light aircraft in accordance with claim 1, wherein each said torsion spring is supported by a first cylindrical tubular section aligned with and inside said torsion spring and a second cylindrical tubular section aligned with and outside said torsion spring, said first cylindrical tubular section and said second cylinder tubular section are clamped between a first flange and a second flange, each said first flange is adjacent each said hinge assembly, and said second flange attached to and spaced from said first flange with a screw which defines said common rotational axis of said hinge assembly and which extends along a central longitudinal axis of said torsion spring.

16. A weather protective roofing structure for light aircraft in accordance with claim 1, wherein one of said covering material segments attached to one of said first outermost bar and said second opposite outermost bar is provided with an entry opening which is sealable by a slide fastener.

17. A weather protective roofing structure for light aircraft in accordance with claim 1, wherein said at least one spring blade of each said torsion spring is detachable connected to an outer surface of one of said first outermost bar and said second opposite outermost bar.

18. A weather protective roofing structure for light aircraft in accordance with claim 1, wherein said tackle apparatus comprises a textile band.

19. A weather protective roofing structure for light aircraft in accordance with claim 1, wherein said tackle apparatus comprises two wire cables extending parallel to one another.

20. A weather protective roofing structure for light aircraft in accordance with claim 19, additionally comprising a plurality of flexible elements fastened to said covering material segments at said bars, said wire cables conducted through said flexible elements.

21. A weather protective roofing structure for light aircraft in accordance with claim 19, additionally comprising a plurality of flexible elements fastened to said covering material segments at said bars, said wire cables conducted over said flexible elements.

22. A weather protective roofing structure for light aircraft in accordance with claim 1, wherein said tackle apparatus comprises a wire cable.

23. A weather protective roofing structure for light aircraft in accordance with claim 22, additionally comprising a plurality of flexible elements fastened to said covering material segments at said bars, said wire cable conducted over said flexible elements.

24. A weather protective roofing structure for light aircraft in accordance with claim 22, additionally comprising a plurality of flexible elements fastened to said covering material segments at said bars, said wire cable conducted through said flexible elements.

25. A weather protective roofing structure for light aircraft, comprising five elongated bars in close side-by-side relation in an open position of said structure and in spaced side-by-side relation in a closed position of said structure, each said bar having the same semicircular configuration; two hinge assemblies, each end of each said bar articulated in a rotatable manner around a common rotational axis at said hinge assemblies; a plurality of covering material segments fastened to one another to form a hemispherical cover and attached to said bars; a tackle apparatus extending over said bars and said covering material segments at about an apex of said bars and in a direction generally perpendicular to a longitudinal axis of each said bar; a torsion spring provided at and aligned with each said hinge assembly so that its operating axis coincides with said common rotational axis of said hinge assemblies, each said torsion spring having at least one spring blade connected to an end of a first outermost bar of said bars, whereby said torsion spring maintains said first outermost said bar at an angle of about 180° from a second opposite outermost bar of said bars to provide a hemispherical enclosure in said closed position, and said bars are rotatable by means of said tackle apparatus to fold said roofing structure in said open position.

26. A weather protective roofing structure for light aircraft in accordance with claim 25, wherein said weather protective roofing structure additionally comprises a winch operatively connected with said tackle apparatus for adjusting said roofing structure to said closed position and said open position.

27. A weather protective roofing structure for light aircraft in accordance with claim 26, wherein said winch is electrical and a remotely controllable electrical power source is operatively connected to said winch.

28. A weather protective roofing structure for light aircraft in accordance with claim 27, wherein said bars have a hollow tubular structure and said at least one spring blade of each said torsion spring is inserted into an interior of one of said first outermost bar and said second opposite outermost bar.

29. A weather protective roofing structure for light aircraft in accordance with claim 28, additionally comprising a moving chassis which is adjustable in height provided on said second opposite outermost bar, said moving chassis comprising a first wheel positioned at one end of said bar, a second wheel positioned at an opposite end of said bar and a third wheel positioned at said apex of said bar, and wherein one of said first wheel and said second wheel is not controllable, while the other of said first wheel and said second wheel, and said third wheel are freely controllable.

30. A weather protective roofing structure for light aircraft in accordance with claim 29, wherein said covering material segments comprise textile cloth-reinforced plastic foil, and each said covering material segment at longitudinal sides of said covering material segments to form a water-tight, reinforced, and overlapping joint.

31. A weather protective roofing structure for light aircraft in accordance with claim 30, additionally comprising a band attached to an inner surface of said hemispherical cover at each said joint of said covering material segments, a width of said band corresponding generally to a circumference of said bars and each said band encircling a corresponding said bar, longitudinal edges of said band forming a plurality of flaps, at least one reinforcing rod inserted in each flap, and said band additionally provided with a plurality of slot apertures and at least one strap threaded through said slot apertures and tighted around said reinforcing rods to securely fasten said covering material segments to said bars.

32. A weather protective roofing structure for light aircraft in accordance with claim 31, wherein each said torsion spring is supported by a first cylindrical tubular section aligned with an inside said torsion spring and a second cylindrical tubular section aligned with and outside said torsion spring, said first cylindrical tubular section and said second cylindrical tubular section are clamped between a first flange and a second flange, each said first flange is adjacent each said hinge assembly, and said second flange attached to and spaced from said first flange with a screw which defines said common rotational axis of said hinge assembly and which extends along a central longitudinal axis of said torsion spring.

* * * * *